US006607285B2

(12) United States Patent
Citron et al.

(10) Patent No.: US 6,607,285 B2
(45) Date of Patent: Aug. 19, 2003

(54) LIGHT ADJUSTMENT APPARATUS

(75) Inventors: Steven D. Citron, Kirkland, WA (US); Darin Richard Aaby, Monroe, WA (US); Bradley Kent Allen, Redmond, WA (US); Michael J. Quiring, Snohomish, WA (US); Mark Christopher Mattson, Oceanside, CA (US); Dabngeun Ngonevolalath, Snohomish, WA (US)

(73) Assignee: Genie Industries, Inc., Redmond, WA (US)

( * ) Notice: Subject to any disclaimer, the term of this patent is extended or adjusted under 35 U.S.C. 154(b) by 0 days.

(21) Appl. No.: 10/053,863

(22) Filed: Jan. 18, 2002

(65) Prior Publication Data

US 2003/0137840 A1 Jul. 24, 2003

(51) Int. Cl.[7] ..... F21V 21/14

(52) U.S. Cl. ..... 362/250; 362/418; 362/419; 362/427; 362/385; 362/386; 362/233; 362/426

(58) Field of Search ..... 362/250, 418, 362/419, 427, 385, 386, 413, 426, 370, 371, 233, 431, 285, 287, 485

(56) References Cited

U.S. PATENT DOCUMENTS 4,228,489 A * 10/1980 Martin ..... 362/250
4,423,471 A 12/1983 Gordin et al.
4,488,209 A 12/1984 Gosswiller
4,712,167 A 12/1987 Gordin et al.
5,207,747 A 5/1993 Gordin et al.
5,272,609 A 12/1993 Nelson
2002/0093822 A1 * 7/2002 Leen ..... 362/253

OTHER PUBLICATIONS

U.S. patent application Ser. No. 09/780,891, Allen et al., filed Feb. 9, 2001.

* cited by examiner

*Primary Examiner*—Sandra O'Shea
*Assistant Examiner*—Tsidu Iko
(74) *Attorney, Agent, or Firm*—Perkins Coie LLP

(57) ABSTRACT

Light adjustment apparatuses and methods for adjusting light assemblies are disclosed herein. One embodiment can include a light holder having a housing, a mounting bracket coupled to the housing, a support member rotatably attached to the mounting bracket, and a lock to restrict the mounting bracket from rotating relative to the support member about an axis of rotation. In another embodiment, a method is provided for adjusting a light assembly. The method includes removing a lock from a first lock receiver in a mounting bracket and a second lock receiver in a support member; rotating the mounting bracket and a light assembly attached to the mounting bracket as a unit so that the light is aimed at a selected orientation; aligning a third lock receiver in the mounting bracket with the second lock receiver in the support member; and placing the lock in the third lock receiver of the mounting bracket and the second lock receiver of the support member.

24 Claims, 4 Drawing Sheets

LIGHT ADJUSTMENT APPARATUS

TECHNICAL FIELD

The present invention is directed to apparatuses for adjusting light assemblies. More particularly, the present invention is directed to apparatuses for adjusting lamp assemblies mounted to towers on lighting systems.

BACKGROUND

Mobile lighting systems are used extensively to provide the necessary light for outdoor and other work sites that lack adequate ambient lighting. Conventional mobile lighting systems often comprise an extendable light tower and an electrical power generator mounted to a trailer. The extendable light tower can be raised to provide the desired illumination once the trailer has been properly positioned at a work site. Typically, the extendable light tower will be rotatably mounted to the trailer so that the lights can be aimed in different directions by rotating the tower relative to the trailer. A rotatable tower allows for changing the horizontal direction of all the lights as a unit; however, it does not allow for each light on the tower to be individually adjusted. To provide proper illumination at a work site, it is often necessary to aim the lights toward a desired area by changing the horizontal and/or vertical direction of some or all of the lights individually. The process of aiming the lights can be difficult and time-consuming.

Many conventional mobile lighting systems allow for adjusting the horizontal and vertical direction of the individual lights to aim the lights. Typically these conventional systems have one or more fasteners that can be manually loosened to permit rotation of the mounting bracket and/or lamp. In these systems, the fasteners, often nuts and bolts, are the same fasteners that secure the lamp to the mounting bracket and secure the mounting bracket to the support member.

Lighting systems that require the securing fasteners to be loosened in order to rotate one of the lamps or mounting brackets have several disadvantages. First, the operator must remember to fully retighten the fasteners after adjustment to prevent them from becoming loose during transport. If the fasteners become loose during transport, there is a chance that the lamp could be damaged. Second, if the fasteners include a nut with nylon (e.g., Nylock nuts and nuts with lock washers), the holding capacity of the nut may degrade each time that it is loosened and retightened. Third, the edges of the fasteners frequently become worn over time because operators sometimes use pliers to tighten and loosen these fasteners instead of the appropriately sized wrench. Fourth, many fasteners require tools, such as wrenches to tighten them. Requiring external tools to adjust fasteners is an inconvenience and sometimes, when tools are not available, prevents proper adjustment of the lights. Some mobile lighting systems attempt to provide tool-less adjustment mechanisms, but often these alternatives have many of the same problems described above.

Many conventional mobile lightening systems have a rotatable tower that permits the lights on the tower to be adjusted as a unit from the ground. Many of these systems have a knob connected to a threaded rod tightened into the tower collar to lock the tower into position. These knob assemblies, however, have several problems. Unless the knob is extremely tight, the wind can cause the tower to rotate. Conversely, if the knob is over-tightened, an operator might not be able to loosen it to rotate the tower. Moreover, the threaded rods are sometimes bent due to overtightening and the threads on the rod are susceptible to becoming gummed up with debris. Bent rods and gummed-up threads are difficult, if not impossible, to tighten. Additionally, some knob assemblies use plastic knobs, which tend to break over time.

SUMMARY

The present invention is directed to light adjustment apparatuses and methods for adjusting light assemblies. In one embodiment of the invention, the apparatus includes a light holder having a housing, a mounting bracket coupled to the housing, a support member and an engagement member. The support member is rotatably attached to the mounting bracket so that the light holder and the mounting bracket can be rotated as a unit about an axis of rotation. The support member or the mounting member has a plurality of locking apertures forming a curve, and the other has at least one receiving aperture. The engagement member is releasably disposed at least partially within one of the locking apertures and the receiving aperture to restrict the mounting bracket from rotating relative to the support member about the axis of rotation.

In another embodiment of the invention, a method of adjusting a light assembly includes removing an engagement member from a first aperture in a mounting bracket and a second aperture in a support member, and rotating the mounting bracket and a light assembly attached to the mounting bracket as a unit so that the light is aimed at a selected orientation. The method further includes aligning a third aperture in the mounting bracket with the second aperture in the support member, and placing the engagement member in the third aperture of the mounting bracket and the second aperture of the support member.

DETAILED DESCRIPTION

In the following description, certain specific details are set forth in order to provide a thorough understanding of various embodiments of the invention. The present disclosure describes light adjustment apparatuses mountable to towers on mobile lighting systems in accordance with one embodiment of the present invention. Many specific details of certain embodiments of the invention are set forth in the following description and in FIGS. 1–5 to provide a thorough understanding of these embodiments. One skilled in the relevant art will understand, however, that the present invention may have additional embodiments, and that the invention may be practiced without several of the details described below. Well-known structures associated with mobile lighting systems, such as telescoping towers and trailer-mounted electrical power generators, have not been shown or described in detail to avoid unnecessarily obscuring the description of the embodiments of the invention.

Figure 1:
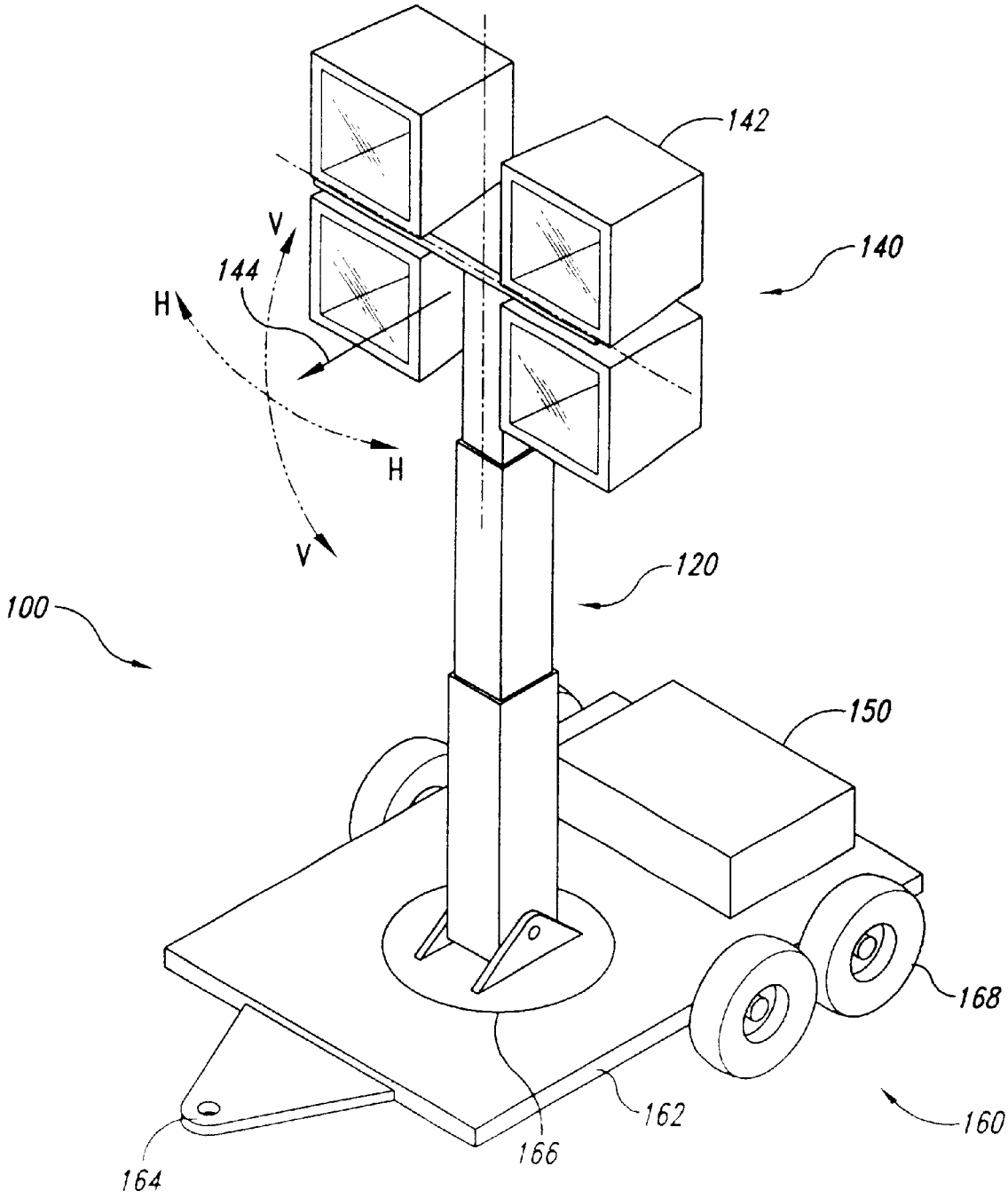
FIG. 1 is an isometric view of a mobile lighting system in accordance with one embodiment of the invention.

FIG. 1 is an isometric view of a mobile lighting system 100 having a light tower 120 with an adjustable lighting assembly 140 in accordance with one embodiment of the invention. In one aspect of this embodiment, the mobile lighting system 100 also includes a trailer 160 and an electrical power generator 150. The trailer 160 has a trailer bed 162 with a tow coupling 164 for attachment to a suitable tow vehicle. A wheel set 168 supports the trailer bed 162 and provides mobility to the mobile lighting system 100. The electrical power generator 150 is mounted to the trailer 160 and can provide electric power for lights 142 on the adjustable lighting assembly 140.

A rotatable coupling 166 mounts the light tower 120 to the trailer bed 162, and is configured to allow vertical rotation of the light tower 120 from an approximately horizontally stowed position to a more vertical operating position, such as that shown in FIG. 1. The rotatable coupling 166 is also configured to allow rotation of the light tower 120 horizontally about an axis perpendicular to the trailer bed 162. Using this horizontal rotation, a projection axis 144 of the lights 142 (as a unit) can be moved along a horizontal arc H—H without moving the trailer 160.

The mobile lighting system 100 is towed to a work site with the light tower 120 in a retracted and horizontally stowed position. Once properly positioned at the site, the light tower 120 can be rotated to a more vertical operating position and extended to a selected height to provide light to the work area of interest. As will be described in greater detail below, the direction of each light housing 142 can be adjusted individually to selectively aim the light to a desired area.

Figure 2:
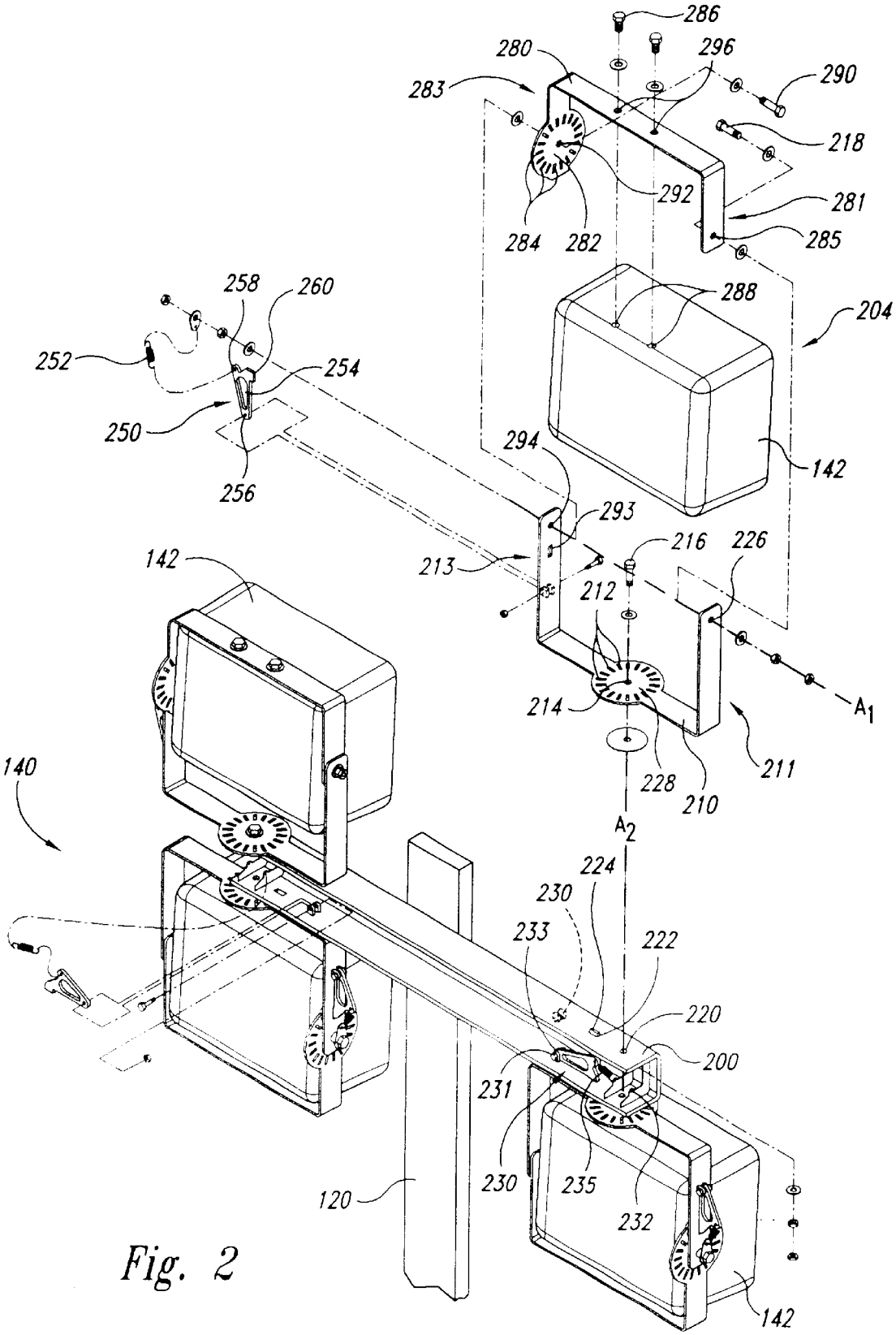
FIG. 2 is an enlarged partial isometric view of an adjustable lighting assembly of FIG. 1, including an exploded view of one of the four adjustable lamp assemblies in accordance with one embodiment of the invention.

FIG. 2 is an enlarged partial isometric view of the adjustable lighting assembly 140 of FIG. 1, including an exploded view of one of the four adjustable lamp assemblies 204 in accordance with one embodiment of the invention. In one aspect of this embodiment, the adjustable lamp assemblies 204 are adjustably connected to a support member 200, which is connected to a top portion of the light tower 120. In the illustrated embodiment, four adjustable lamp assemblies 204 are connected to the horizontally oriented support member 200. In alternative embodiments, a different number of lamp assemblies 204 can be connected to the support member 200. In addition, the lamp assemblies 204 can be configured differently; for example, all the lamp assemblies 204 could be connected to the top of the support member 200, or all the assemblies 204 could be connected to the bottom of the support member 200. Moreover, the support member 200 can be oriented differently, such as generally vertically or at an angle relative to the light tower 120.

The adjustable lamp assemblies 204 of the illustrated embodiment are rotatable relative to the support member 200 about two orthogonal axis of rotation to facilitate the proper aiming of the light. The adjustable lamp assemblies 204, in the illustrated embodiment, include a first mounting member 280 attached to the light housing 142 (which contains a light bulb) and a second mounting member 210 rotatably connected to the first mounting member 280. The first mounting member 280 is an elongated plate bent at right angles proximate a first end 281 and a second end 283. The second end 283 includes a circular section 282 having a plurality of rectangularly-shaped lock receivers or apertures 284 oriented in a generally circular arrangement. In alternative embodiments, the first mounting member 280 might not have a circular section, but rather the bracket could be wide enough to accommodate the apertures 284. In other embodiments, the apertures 284 may have a different shape, such as circular, and the apertures 284 may be oriented in a different pattern, such as a curve.

The first mounting member 280 is fixedly attached to the light housing 142 by fasteners 286. The fasteners 286 in the illustrated embodiment are bolts that extend through apertures 296 in the first mounting member 280 and into apertures 288 in the light housing 142. Accordingly, the first mounting member 280 is fixed to the light housing 142 and moves with the light housing 142 as a unit. In alternative embodiments, the first mounting member 280 can be attached to the light housing 142 using other means, or at other locations on the light housing 142.

In the illustrated embodiment, the first mounting member 280 is attached to the second mounting member 210, which is rotatably attached to the support member 200. The second mounting member 210 is an elongated plate bent at right angles proximate a first end 211 and a second end 213. The first end 211 of the second mounting member 210 is pivotally connected to the second end 283 of the first mounting member 280, and the second end 213 of the second mounting member 210 is pivotally connected to the first end 281 of the first mounting member 280. In the illustrated embodiment, a fastener 290 passes through an aperture 292 in the center of the circular section 282 of the first mounting member 280 and through an aperture 294 in the second end 213 of the second mounting member 210 to rotatably connect the second ends 283 and 213 of the first and second mounting members 280 and 210. Another fastener 218 passes through an aperture 285 in the first end 281 of the first mounting member 280 and an aperture 226 in the first end 211 of the second mounting member 210 to rotatably connect the first ends 281 and 211 of the first and second mounting members 280 and 210. The fasteners 290 and 218 and the apertures 296, 288, 292, and 294 are all axially aligned, so that the two points of connection are on a first axis of rotation $A_1$. Accordingly, the first mounting member 280 and the light housing 142 can rotate as a unit relative to the second mounting member 210 and the support member 200 to adjust the direction of the light housing 142.

In the illustrated embodiment, the first axis of rotation $A_1$ is substantially horizontal and allows the respective light housing 142 to be aimed vertically. In alternative embodiments, the first axis of rotation $A_1$ can be substantially vertical or at an angle. In other embodiments, the first mounting member 280 can be rotatably connected to the second mounting member 210 by only one connection point. In other embodiments, the first and second mounting members 280 and 210 might have different shapes or configurations.

Figure 3:
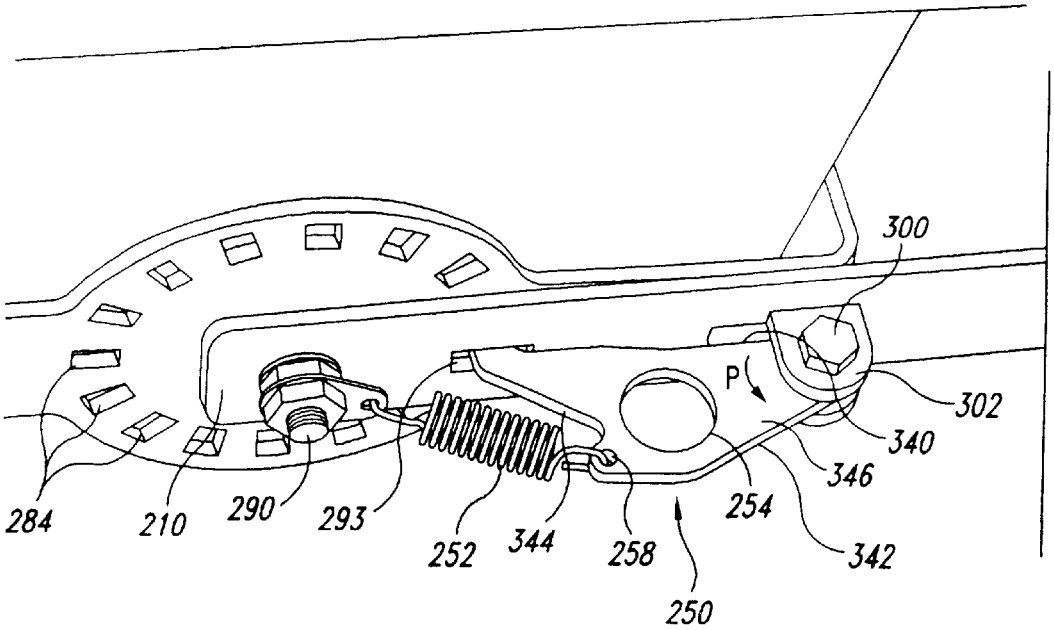
FIG. 3 is an enlarged isometric view of a portion of one of the adjustable lamp assemblies of FIG. 2.

When the first and second mounting members 280 and 210 are rotated relative to each other, the circular section 282 (and apertures 284) on the second end 283 of the first mounting member 280 rotates about the first axis of rotation $A_1$. The circular section 282 is configured so that each of the apertures 284 can be axially aligned with an aperture 293 formed in the second end 213 of the second mounting member 210, depending upon the angular orientation between the first and second mounting members 280 and 210. In the illustrated embodiment, a lock 250 is pivotally attached to the second mounting member 210 on the second end 213 so as to removably extend through the apertures 293 and 284 to prevent rotation of the first mounting member 280 and the light housing 142 until the lock 250 is removed from the apertures 293 and 284. FIG. 3 is a picture of a portion of one of the adjustable lamp assemblies 204 of FIG. 2. As best shown in FIG. 3, the lock 250 has a first side 340, a second side 342, a third side 344, a top surface 346 and a bottom surface (not shown). The lock 250 also has a tip 260 (best seen in FIG. 2) that projects generally perpendicularly from the first side 340. The tip 260 of the lock 250 is removably disposed within the aperture 293 in the second end 213 of the second mounting member 210 and within one of the plurality of apertures 284 in the circular portion 282 of the first mounting member 280. The tip 260, when positioned within one of the apertures 284, blocks rotational motion between the second mounting member 210 and the first mounting member 280 along the first axis of rotation $A_1$.

A biasing member 252 is connected to the lock 250 to urge the tip 260 of the lock 250 to remain within one of the plurality of apertures 284. One end of the biasing member 252 is connected to an aperture 258 on the lock 250 located proximate to the junction of the third side 344 and the second side 342, and the other end of the biasing member 252 is connected to the fastener 290. The biasing member 252 exerts a force along its axis that has a component which urges the tip 260 of the lock 250 through the aperture 293 in the second end 213 of the second mounting member 210 so as to remain within one of the apertures 284 of the first mounting member 280. In the illustrated embodiment, the biasing member 252 is a spring; however, other means can be used to urge the tip 260 to remain within one of the plurality of apertures 284. The lock 250 also has an enlarged aperture 254 therein between the first and second sides 340 and 342. The enlarged aperture 254 is sized to allow an operator to place a finger through the aperture 254 and pull or otherwise exert a force on the lock 250 to remove the tip 260 of the lock 250 from one of the apertures 284.

The lock 250 is pivotally connected to the second mounting member 210 in the illustrated embodiment. The lock 250 has an aperture 256 (shown in FIG. 2) proximate to the junction of the first and second sides 340 and 342. The second mounting member 210 has two spaced-apart projections 302 that extend in a direction perpendicular to the second end 213. The portion of the lock 250 with the aperture 256 therethrough is pivotally positioned between the two projections 302. A fastener 300 passes through the two projections 302 and through the aperture 256 in the lock 250, so that the lock 250 pivots about the fastener 300. When an operator pulls on the lock 250, the lock 250 pivots in the direction P (shown in FIG. 3), thereby causing the tip 260 to be removed from one of the plurality of apertures 284. Once the tip 260 is removed from the apertures 284, the first mounting member 280 and light housing 142 can be angularly adjusted relative to the support member 200 to a new position wherein another one of the apertures 284 is aligned to receive the tip 260 therein. Therefore, the angular orientation of the light housing 142 can be quickly and easily adjusted by an operator without requiring tools to manually loosen and tighten the light housing.

Referring to FIG. 2, in the illustrated embodiment, the second mounting member 210 is rotatably attached to the support member 200. The second mounting member 210 includes a circular section 228 between the first end 211 and the second end 213. The circular section 228 includes a plurality of rectangularly-shaped lock receivers or apertures 212 oriented in a generally circular arrangement. A fastener 216 passes through an aperture 214 in the circular section 228 of the second mounting member 210 and through an aperture 220 in the support member 200 to connect the second mounting member 210 to the support member 200. The fastener 216 creates a second axis of rotation $A_2$ about which the second mounting member 210, the first mounting member 280 and the light housing 142 can rotate as a unit relative to the support member 200. In the illustrated embodiment, the second axis of rotation $A_2$ permits each adjustable lamp assembly 204 to be aimed horizontally. In other embodiments, depending on the configuration of the second mounting member 210 and the orientation of the support member 200, the second axis of rotation $A_2$ may provide the ability to aim the lamp assembly 204 in other directions.

As seen in FIG. 2, a retractable lock 230 is mounted to the support member 200 and is positioned so a tip 224 of the lock projects through an aperture 222 in the support member 200. The aperture 224 in the support member 200 is positioned so it axially aligns with one of the apertures 212 in the circular section 228 in the second mounting member 210 when the second mounting member is rotated about the second axis $A_2$ to a desired position. The tip 224 of the lock 230 extends through the one of the plurality of apertures 212 aligned with the support member's aperture 222 to restrict rotation of the second mounting member 210 relative to the support member 200 about the second axis of rotation $A_2$.

The features and shape of lock 230 are similar to lock 250 described above. A fastener 231 attaches the lock 230 to two projections 233 that extend perpendicularly from the support member 200; accordingly, the lock 230 can pivot about the fastener. The arrangement is similar to that shown in FIG. 3 except that the biasing member 235 is attached to a rib 232 on the support member 200. In alternative embodiments, the lock 230 and biasing member 235 can be different from the lock 250 and biasing member 252 described above. In other embodiments, the biasing member 235 can be connected to something other than the rib 232, provided that it continues to urge the tip 224 of the lock 230 into one of the plurality of apertures 212 on the second mounting member 210. The lock 230, therefore, removably restricts the second mounting member 210 from rotating relative to the support member 200 about the second axis of rotation $A_2$.

The lock-plurality-of-apertures arrangement allows each light housing 142 in the adjustable lightening assembly 140 to be individually adjusted in a safe, quick and convenient manner without requiring additional tools and without loosening the fasteners that hold the adjustable lamp assemblies 204 to the light tower's support member 200. In the illustrated embodiment, the adjustable lamp assembly 204 has two separate axes of rotation $A_1$ and $A_2$ enabling each lamp assembly 204 to be individually adjusted and aimed in a selected direction vertically and horizontally. In alternative embodiments, the adjustable lamp assembly 204 can be configured for adjustment about only one of the axes of rotation $A_1$ or $A_2$. In one embodiment, in which the first mounting member 280 has one of the plurality of apertures and the lock, and the second mounting member 210 includes the other, the second mounting member can be considered a support member.

Figure 4:
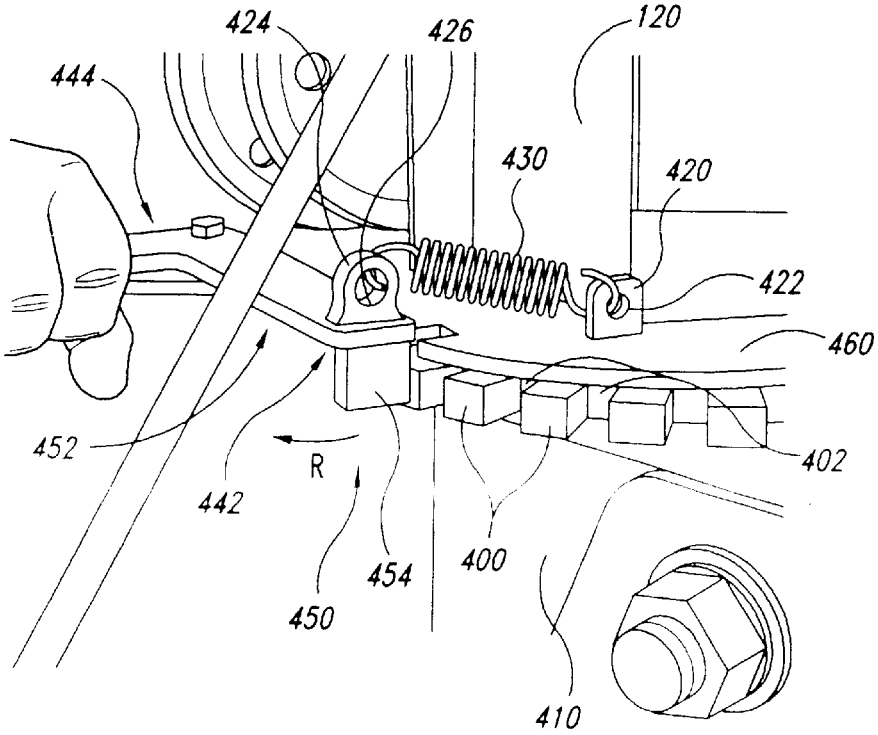
FIG. 4 is an isometric view of a portion of a tower locking assembly in accordance with one embodiment of the invention.

In one embodiment, the light tower 120 is rotatable about its longitudinal axis relative to the trailer 162. FIG. 4 is an isometric view of a portion of the light tower 120 and a tower locking assembly 450. A lower portion of the light tower 120 is rotatably received in a base 410 that is fixed to the trailer 162. The light tower 120 is rotatable about its longitudinal axis relative to the base 410 so that the lights 142 coupled to the light tower 120 can be aimed at a selected location without moving the trailer. The tower locking assembly 450 releasably restricts rotation of the tower 120 about its longitudinal axis. In the illustrated embodiment, the tower locking assembly 450 includes an annular flange 460 attached to the tower 120, teeth 400 spaced radially around the base 410, and a lock 452 attached to the annular flange 460. The lock 452 is an elongated flat member with a first end portion 442 connected to a handle 444. The first end portion 442 has a tip 454 that is sized to fit, at least partially, between two of the teeth 400. When the tip 454 is removably received between two of the teeth 400, the rotation of the tower 120 along its axis is restricted. The spaces between the teeth 400 are cutouts 402, which in the illustrated embodiment are grooves; however, in alternative embodiments, the cutouts 402 can be apertures. In other embodiments, the teeth 400 can be attached to the tower 120, and the lock 452 can be attached to the base 410. Furthermore, the configuration and shape of the lock 452, teeth 400 and cutouts 402 can be different. For example, in one embodiment, the lock can be a rod that is removably received in one of a plurality of apertures in the base.

The first end portion 442 of the lock 452 has a projection 424 with an aperture 426 for connection to one end of a biasing member 430. The other end of the biasing member 430 is attached to an aperture 422 in a projection 420 on the annular flange 460. The biasing member 430 urges the tip 454 of the lock 452 into the selected one of the cutouts 402. In the illustrated embodiment, the biasing member 430 is a spring; however, in alternative embodiments, other elastic members can be used.

Figure 5:
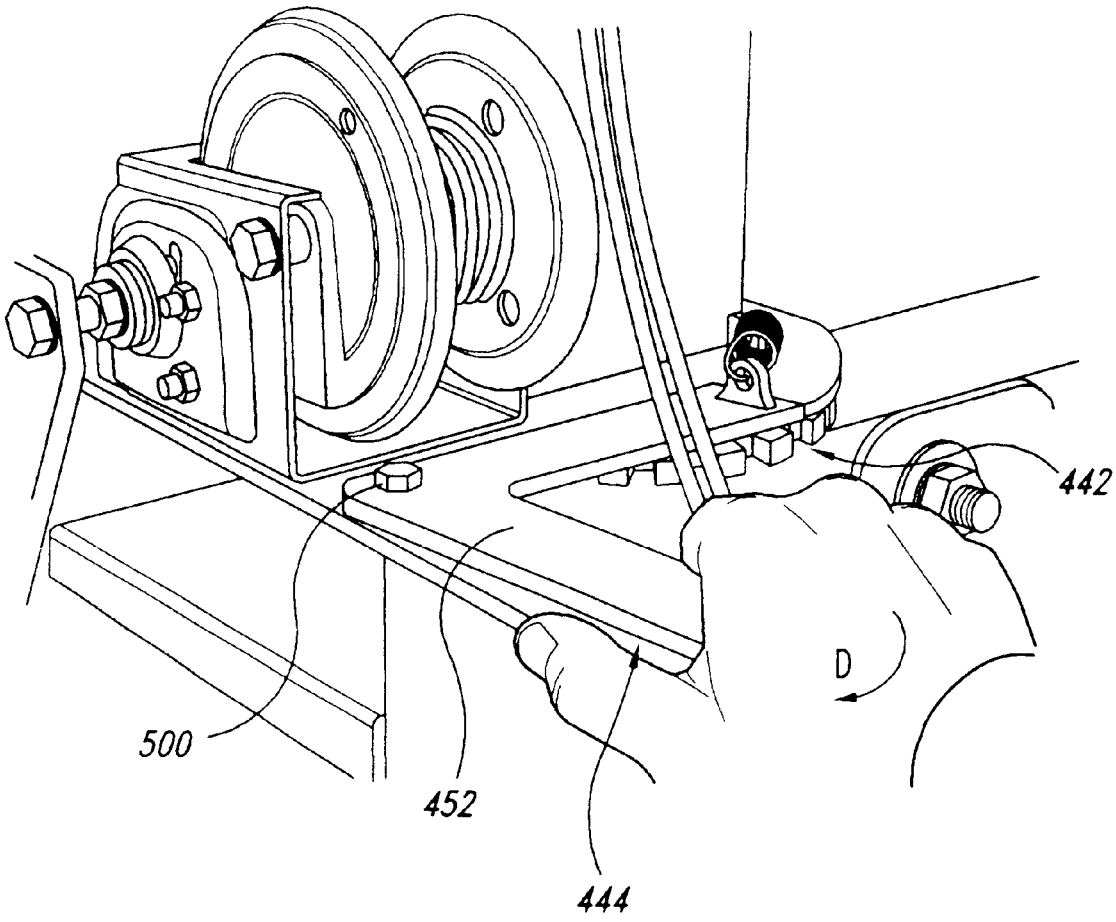
FIG. 5 is an isometric view of a portion of the tower locking assembly of FIG. 4.

FIG. 5 is an isometric view of a portion of the tower locking assembly 450 of FIG. 4. A fastener 500 is placed through an aperture (not shown) in the lock 452 between the first end 442 and the handle 444 to connect the lock 452 to the annular ring 460. An operator can rotate the lock 452 about the fastener 500 by moving the handle 444 in a direction D causing the first end 442 of the lock 452 to move in the direction R (FIG. 4). Therefore, by moving the handle 444 in the direction D an operator can remove the tip 454 from one of the cutouts 402, and thus permit rotation of the tower 120 about its axis. In alternative embodiments, the lock 452 and/or handle 444 can have different configurations and shapes.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A light adjustment apparatus, comprising:

a light holder having a housing;

a mounting bracket coupled to the housing, the mounting bracket having a plurality of locking apertures sequentially aligned;

a support member rotatably attached to the mounting bracket so that the light holder and mounting bracket can be rotated as a unit relative to the support member about an axis of rotation, the support member having a first aperture; and an engagement member releasably engaging the mounting bracket to selectively restrict the mounting bracket from rotating relative to the support member, the engagement member being placed into the first aperture in the support member and one of the plurality of locking apertures in the mounting bracket, thereby restricting rotation of the mounting bracket about the axis of rotation.

2. The apparatus of claim 1, further comprising a biasing member urging the engagement member into the first aperture and one of the plurality of locking apertures.

3. The apparatus of claim 1, further comprising:

a trailer having a trailer bed coupled to a wheel assembly; and an extendable tower having first and second tower portions moveable relative to each other, the extendable tower being operatively coupled to the trailer bed;

wherein the support member is coupled to one of the first and second tower portions.

4. The apparatus of claim 1 wherein having a plurality of locking apertures sequentially aligned includes having a plurality of locking apertures forming a generally circular shape.

5. The apparatus of claim 1 wherein the mounting bracket includes a first mounting member and a second mounting member, the axis of rotation is a first axis of rotation, the plurality of locking apertures is a first plurality of locking apertures, the engagement member is a first engagement member, and the first mounting member has the first plurality of locking apertures;

wherein the support member is rotatably attached to the first mounting member so that the light holder and first mounting member can be rotated as a unit relative to the support member about the first axis of rotation;

wherein the first engagement member releasably engages the first mounting member to selectively restrict the first mounting member from rotating relative to the support member when the first engagement member is placed into the first aperture in the support member and one of the first plurality of locking apertures in the first mounting member, thereby restricting rotation of the first mounting member about the first axis of rotation;

wherein the second mounting member is coupled to the housing, and the first mounting member is rotatably attached to the second mounting member so that the second mounting member and the housing can be rotated as a unit relative to the first mounting member about a second axis of rotation, wherein one of the second mounting member and the first mounting member has a second plurality of locking apertures forming a curve and the other has at least one second aperture; and wherein a second engagement member is releasably disposed at least partially within one of the second plurality of locking apertures and one of the at least one second aperture to restrict the second mounting member from rotating relative to the first mounting member about the second axis of rotation, wherein one of the second plurality of locking apertures and one of the at least one second aperture are axially aligned.

6. A lamp aiming apparatus usable on a light tower, the apparatus comprising:

a light;

a mounting bracket attached to the light, the mounting bracket having a plurality of locking apertures forming a curve about an axis of rotation;

a support member having a first aperture, the support member being rotatably attached to the mounting bracket so that the light can be aimed at a selected orientation; and a lock releasably engaging the first aperture in the support member and one of the plurality of locking aperture in the mounting bracket to prevent rotation between the mounting bracket and support member about the axis of rotation.

7. The apparatus of claim 6, further comprising a biasing member urging the lock into the first aperture and one of the plurality of locking apertures.

8. The apparatus of claim 6 wherein the mounting bracket includes a mounting member;

wherein the support member is rotatably attached to the mounting member so that the light and mounting member can be rotated as a unit relative to the support member about the axis of rotation; and the lock releasably engages the mounting member to selectively restrict the mounting member from rotating relative to the support member when the lock is placed into the first aperture in the support member and one of the plurality of locking apertures in the mounting member, thereby restricting rotation of the mounting member about the axis of rotation.

9. The apparatus of claim 6 wherein the mounting bracket includes a first mounting member and a second mounting member, the axis of rotation is a first axis of rotation, the plurality of locking apertures is a first plurality of locking apertures, the lock is a first lock;

wherein the support member is rotatably attached to the first mounting member so that the light and first mounting member can be rotated as a unit relative to the support member about the first axis of rotation;

the first lock releasably engages the first mounting member to selectively restrict the first mounting member from rotating relative to the support member when the first lock is placed into the first aperture in the support member and one of the first plurality of locking apertures in the first mounting member, thereby restricting rotation of the first mounting member about the first axis of rotation;

the second mounting member is coupled to the light, and the first mounting member is rotatably attached to the second mounting member so that the second mounting member and the lamp assembly can be rotated as a unit relative to the first mounting member about a second axis of rotation, wherein one of the second mounting member and the first mounting member has a second plurality of locking apertures forming a curve and the other has at least one second aperture; and wherein a second lock is releasably disposed at least partially within one of the second plurality of locking apertures and one of the at least one second aperture to restrict the second mounting member from rotating relative to the first mounting member about the second axis of rotation, wherein one of the second plurality of locking apertures and one of the at least one second aperture are axially aligned.

10. A light adjustment apparatus, comprising:

a light holder having a housing;

a mounting bracket coupled to the housing;

a support member rotatably attached to the mounting bracket so that the light holder and the mounting bracket can be rotated as a unit about an axis of rotation, wherein one of the support member and the mounting bracket has a plurality of spaced-apart lock receivers sequentially aligned; and a lock releasably disposed at least partially within one of the plurality of lock receivers and positioned to engage the one of the support member and the mounting bracket to restrict the mounting bracket from rotating relative to the support member about the axis of rotation.

11. The apparatus of claim 10 wherein the plurality of lock receivers are a plurality of apertures aligned to form a curve about an axis of rotation.

12. The apparatus of claim 10 wherein the plurality of lock receivers are in the mounting bracket.

13. The apparatus of claim 10 wherein the plurality of lock receivers are locking apertures in the mounting bracket, and the support member includes an aperture that removably receives a portion of the lock and that axially aligns with one of the locking apertures.

14. The apparatus of claim 10, further comprising a biasing member urging the lock into one of the lock receivers.

15. The apparatus of claim 10, further comprising:

a trailer having a trailer bed coupled to a wheel assembly; and an extendable tower having first and second tower portions moveable relative to each other, the extendable tower being operatively coupled to the trailer bed;

wherein the support member is coupled to one of the first and second tower portions.

16. The apparatus of claim 10 wherein the mounting bracket includes a first mounting member and a second mounting member, the plurality of lock receivers is a first plurality of lock receivers, the lock is a first lock, and the axis of rotation is a first axis of rotation;

wherein the support member is rotatably attached to the first mounting member so that the light holder and first mounting member can be rotated as a unit about the first axis of rotation;

wherein the first lock is releasably disposed at least partially within one of the first plurality of lock receivers to restrict the first mounting member from rotating relative to the support member about the first axis of rotation;

wherein the second mounting member is coupled to the light holder, and the first mounting member is rotatably attached to the second mounting member so that the second mounting member and the light holder can be rotated as a unit relative to the first mounting member about a second axis of rotation, wherein one of the second mounting member and the first mounting member has a second plurality of spaced-apart lock receivers sequentially aligned; and wherein a second lock is releasably disposed at least partially within one of the second plurality of lock receivers to restrict the second mounting member from rotating relative to the first mounting member about the second axis of rotation.

17. A mobile lighting system having an extendable light tower with an adjustable light assembly usable for lighting a work area, the mobile lighting system comprising:

a trailer having a trailer bed;

an extendable tower having first and second tower portions moveable relative to each other, the extendable tower being operatively coupled to the trailer bed;

a support member coupled to one of the first and second tower portions, the support member having a first aperture;

a light assembly;

a mounting bracket coupled to the light assembly, the mounting bracket having a plurality of locking apertures forming a curve, the mounting bracket being rotatably attached to the support member so that the light assembly and mounting bracket can be rotated as a unit relative to the support member about an axis of rotation; and a lock releasably engaging the mounting bracket to selectively restrict the mounting bracket from rotating relative to the support member, the lock being placed into the first aperture in the support member and one of the plurality of apertures in the mounting bracket, thereby restricting rotation of the mounting bracket about the axis of rotation.

18. The apparatus of claim 17, further comprising a biasing member urging the lock into the first aperture and one of the plurality of locking apertures.

19. The apparatus of claim 17 wherein the mounting bracket includes a first mounting member and a second mounting member, the axis of rotation is a first axis of rotation, the plurality of locking apertures is a first plurality of locking apertures, the lock is a first lock, and the first mounting member has the first plurality of locking apertures;

wherein the support member is rotatably attached to the first mounting member so that the light assembly and first mounting member can be rotated as a unit relative to the support member about the first axis of rotation;

wherein the first lock releasably engages the first mounting member to selectively restrict the first mounting member from rotating relative to the support member when the first lock is placed into the first aperture in the support member and one of the first plurality of locking apertures in the first mounting member, thereby restricting rotation of the first mounting member about the first axis of rotation;

wherein the second mounting member is coupled to the light assembly, and the first mounting member is rotatably attached to the second mounting member so that the second mounting member and the light assembly can be rotated as a unit relative to the first mounting member about a second axis of rotation, wherein one of the second mounting member and the first mounting member has a second plurality of locking apertures forming a curve and the other has at least one second aperture; and wherein a second lock is releasably disposed at least partially within one of the second plurality of locking apertures and one of the at least one second aperture to restrict the second mounting member from rotating relative to the first mounting member about the second axis of rotation, wherein one of the second plurality of locking apertures and one of the at least one second aperture are axially aligned.

20. A lamp aiming apparatus usable on a tower, the apparatus comprising:

a light holder having a housing;

a first mounting member coupled to the housing;

a second mounting member rotatably attached to the first mounting member so that the first mounting member and the housing can be rotated as a unit relative to the second mounting member about an axis of rotation, wherein one of the first mounting member and the second mounting member has a plurality of spaced-apart lock receivers sequentially aligned; and a lock releasably disposed at least partially within one of the plurality of lock receivers to restrict the first mounting member from rotating relative to the second mounting member about the axis of rotation.

21. A light adjustment apparatus, comprising:

a light holder having a housing;

a first mounting member having a first plurality of spaced-apart locking apertures;

a support member having a first aperture, the support member being rotatably attached to the first mounting member so that the light holder and first mounting member can be rotated as a unit relative to the support member about a first axis of rotation;

a first lock releasably engaging the first mounting member to selectively restrict the first mounting member from rotating relative to the support member, the first lock being placed into the second aperture in the support member and one of the first plurality of locking apertures in the first mounting member, thereby restricting rotation of the first mounting member about the first axis of rotation;

a second mounting member coupled to the housing, wherein the first mounting member is rotatably attached to the second mounting member so that the second mounting member and the housing can be rotated as a unit relative to the first mounting member about a second axis of rotation, wherein one of the second mounting member and the first mounting member has a second plurality of spaced-apart locking apertures and the other has at least one second aperture; and a second lock releasably disposed within one of the second plurality of locking apertures and one of the at least one second aperture to restrict the second mounting member from rotating relative to the first mounting member about the second axis of rotation, wherein one of the second plurality of locking apertures and one of the at least one second aperture are axially aligned.

22. A light tower locking apparatus, comprising:

a tower having a first end portion and a second end portion;

a lamp assembly coupled to the tower proximate the first end portion;

a receiving member having an aperture that axially receives a portion of the second end portion of the tower, wherein the tower and the lamp assembly are rotatable as a unit relative to the receiving member about an axis of rotation; and a lock coupled to one of the tower and the receiving member, wherein the other of the tower and the receiving member includes a plurality of lock receivers, and the lock is releasably disposed at least partially within one of the plurality of lock receivers to restrict rotation of the tower about the axis of rotation relative to the receiving member.

23. The apparatus of claim 22, further comprising a biasing member urging the lock into one of the plurality of lock receivers.

24. A method for adjusting a light on an extendable light tower assembly, comprising:

removing a lock from a first lock receiver in a mounting bracket and a second lock receiver in a support member;

rotating the mounting bracket and a light assembly attached to the mounting bracket as a unit so that the light is aimed at a selected orientation;

aligning a third lock receiver in the mounting bracket with the second lock receiver in the support member; and placing the lock in the third lock receiver of the mounting bracket and in the second lock receiver of the support member.

* * * * *